United States Patent [19]

Semanaz et al.

[11] 4,272,673

[45] Jun. 9, 1981

[54] HEATING ELEMENT

[75] Inventors: Daniel Semanaz, Vernaison; Robert Cassat, Ternay, both of France

[73] Assignee: Rhone-Poulenc Industries, Paris, France

[21] Appl. No.: 30,637

[22] Filed: Apr. 16, 1979

Related U.S. Application Data

[63] Continuation of Ser. No. 828,603, Aug. 29, 1977, abandoned, which is a continuation of Ser. No. 813,353, Jul. 6, 1977, abandoned.

[30] Foreign Application Priority Data

Jul. 6, 1976 [FR] France ..... 76 21205
Nov. 15, 1976 [FR] France ..... 76 34843

[51] Int. Cl.[3] ..... H05B 3/36

[52] U.S. Cl. ..... 219/544; 219/345; 219/528; 219/535; 219/536; 219/552; 260/30.6 R; 338/264; 338/301

[58] Field of Search ..... 219/345, 528, 535, 536, 219/544, 545, 549, 552, 553; 338/264, 208, 263, 301, 270; 260/30.6, 78 UA; 134/110 R

[56] References Cited

U.S. PATENT DOCUMENTS

| | | | |
|---|---|---|---|
| 1,010,641 | 12/1911 | Knight et al. | 338/264 |
| 1,026,377 | 5/1912 | Barringer | 338/264 |
| 2,026,616 | 1/1936 | Dike | 338/264 |
| 2,195,705 | 4/1940 | Morgan | 338/264 X |
| 2,213,969 | 9/1940 | Ruben | 338/264 X |
| 2,783,358 | 2/1957 | Wolf | 219/345 X |
| 3,031,739 | 5/1962 | Boggs | 219/345 |
| 3,265,858 | 8/1966 | MacGuire | 219/345 |
| 3,541,038 | 11/1970 | Nakano et al. | 260/30.6 |
| 3,584,198 | 6/1971 | Doi et al. | 219/549 |
| 3,740,529 | 6/1973 | Falk | 219/535 |

FOREIGN PATENT DOCUMENTS

| | | | |
|---|---|---|---|
| 2346648 | 9/1973 | Fed. Rep. of Germany | 219/345 |
| 2357727 | 11/1973 | Fed. Rep. of Germany | 219/345 |
| 796138 | 1/1936 | France | 219/345 |
| 2305088 | 3/1974 | France | 219/345 |
| 1168978 | 10/1966 | United Kingdom | 260/30.6 |
| 1400512 | 10/1972 | United Kingdom | 260/30.6 |

*Primary Examiner*—Volodymyr Y. Mayewsky
*Attorney, Agent, or Firm*—Burns, Doane, Swecker & Mathis

[57] ABSTRACT

A heating element is comprised of [A] a shaped, electrically insulating substrate, said substrate including a reinforced polyimide composite, [B] a continuous, electric resistor element in entwining relationship with, and at least partially inlain within said composite [A], said electric resistor element being coated with a thermostable electrically insulating coating, and [C] means for coupling said electric resistor element [B] with an electric power source. Techniques for the fabrication of such heating elements are also disclosed.

26 Claims, 10 Drawing Figures

HEATING ELEMENT

CROSS REFERENCE TO RELATED APPLICATIONS

This is a continuation application of our copending application Ser. No. 828,603, filed Aug. 29, 1977, now abandoned which was a continuation of copending application, Ser. No. 813,353, filed July 6, 1977, now abandoned, and both copending prior applications are hereby expressly incorporated by reference and relied upon.

BACKGROUND OF THE INVENTION

1. Field of the Invention

The present invention relates to heating elements, and, more especially, to heating elements of a type comprising an electric resistor and a composite, electrically insulating substrate therefor.

2. Description of the Prior Art

It has long been known to the art to embed electric resistors within various polymeric materials. For example, French Pat. No. 796,138 describes electric resistors embedded within certain methacrylic polymers. This patent also describes a device wherein a resistor wire is wound into a plate or frame of synthetic material, which in turn is itself embedded in the same synthetic material, or in a different synthetic material. This technique makes it possible to avoid using such massive heating equipment wherein an unprotected electric resistor is exposed to ambient conditions, and which merely is borne by any suitable support. But taking into account the resins available at the time of the filing of this French patent, it is obvious that such heating elements could not be brought to a high temperature without causing the decomposition, or thermal degradation, of the polymer comprising the same. And as soon as one effected a reduction in working temperatures, it logically followed that it was not possible to produce either heating elements having a sufficiently high heating power per unit surface, or radiant heating elements. The term radiant heating element of course denotes any heating element which can effect the transfer of heat through rays or radiation. This particular method of heating is quite useful and highly advantageous in certain applications, especially where it is desired to obtain rapid and localized heating with an installation of but limited power. With respect to the construction or fabrication of heating elements having a high power per unit surface, difficult technical problems arise, namely firstly, if a large number of electric resistor wires are mounted in the heating element, or if such wires are not arranged in an exact and uniform pattern, there is a great risk that such wires may come into contact with one another and cause partial short circuits, with all attendant consequences; secondly, if the electric resistor wires are not suitably coated with resin, the heat produced by the wires is but poorly transmitted and there is a risk of overheating of the wires, which, next giving use to excessive temperatures, favors local thermal degradation of the resin; thirdly, if such heating elements are used in applications such as electric household appliances, in which the user has no especial training, it is necessary that the heating elements be capable of being used with marked safety, and some government or other standards even direct that the heating element should withstand without damage the direct action of a stream of water; fourthly, if the amount of resin in which the electric resistor wires are buried is too large, the heating elements may become too expensive; and fifthly, on the other hand, the amount of resin in which the electric resistor wires are buried is too small, or the electric resistor wires are improperly arranged there is a corresponding risk that the heat produced may be poorly distributed over the surface of the heating element, which would be harmful for certain applications, as well as to the resin comprising heating element.

Therefore, it is indeed quite difficult to produce acceptable heating elements having a high power per unit surface, and it is accordingly trivially apparent that, in order to produce same, one could not simply avail oneself of the teachings of the aforesaid French Pat. No. 796,138 by simply replacing the resins of that day with today's more thermally stable resins.

Developments contributing to the state of the art, subsequent to that described in the noted French Pat. No. 796,138, include:

That disclosed in the published German patent application, No. 2,346,648, i.e., a device in which electric resistor wires, arranged in parallel array, are embedded under pressure in a mixture of phenolic resin and either sawdust or wood chips; the structure of such device, however, does not display the properties required for fabrication of a good radiant heating element, or one yielding high power per unit surface.

Also, in published German patent application No. 2,357,727, there is described a pliable mat composed of heat conductors embedded in an insulating material and covered with a sheet of aluminum foil; but the purpose of such a device is simply to make possible the defrosting of food and other dishes kept at a very low temperature. It is thus quite obvious that such a device is as remote as possible from useful radiant heating elements or from heating elements yielding high power per unit surface.

And French Pat. No. 1,490,850 discloses flexible electric heating elements, of the fabric, or wire or cord type, but, as a result of their very nature, these are heating elements which are not self-sustaining. In many applications, therefore, such elements must be complemented by reinforcement or suitable support, or even be attached to the object sought to be heated.

The focus of French Pat. No. 2,158,258 are heating elements desired to equip structures or containers in which the heating element is secured contiguous the surface of the particular structure under consideration. For this purpose, a stratified preparation impregnated with certain polyimides in the form of pre-polymers is prepared, and thence the polymerization is completed in situ, when the stratified preparation is already installed on the structure sought to be heated. It is apparent that this method of construction is practicable only when it is possible or feasible to permanently connect the heating element to the object to be heated, and only when the latter can be heated by direct conduction; accordingly, such patented invention can be utilized for but a limited number of applications.

Compare also the French Patent of Addition No. 2,305,088, available to the public as of October, 1976, and wherein are described radiation heating elements which include a support based on a thermostable resin (for example, polyimide), transparent to infrared radiation, and silica-based fibers, on which support is mounted an electric resistor circuit, in the standard manner of printed circuits, on a thin layer (a few microns), and the entire assembly is coated with an insulating varnish, such as silicone, and with a metallic reflecting layer serving as a reflector. Such a device nonetheless manifests a number of drawbacks; firstly as a result of its thinness, the electric resistor circuit tends to become oxidized and then, therefore, to break (especially when made from copper or silver); secondly when made from metals which are difficult to oxidize, this type of electric resistor circuit requires techniques poorly suited to industrial-scale production for its manufacture, which makes them expensive; thirdly the electric resistor circuit usually includes a profile with projections, which has a deleterious effect on the quality of electrical insulation and on the effectiveness of the performance of the silicone varnish (risk of cracking as a result of point effect); and fourthly the latter drawback is even more emphasized as the metal reflector has a definite tendency to produce short circuits with the electric resistor circuits.

SUMMARY OF THE INVENTION

Accordingly, a primary object of the present invention is to provide heating elements which do not exhibit the disadvantages and drawbacks of those heating elements heretofore known to the art.

Another object of the invention is to provide heating elements capable of developing a high heating power per unit time, such power being specifically capable of being transmitted, as appropriate, either by radiation or by conduction.

Yet another object of the present invention is to provide heating elements which are self-sustaining and need not be permanently connected to the object sought to be heated.

These and other objects and advantages of the present invention will become more apparent from the description which follows.

Briefly, it has now been found that the foregoing and other objects of the invention can be attained by the provision of a novel heating element characterized in that the same includes:

(A) a shaped electrically-insulating material or substrate composed of a combination of a strength reinforcing filler or charge, elongate in geometrical configuration, and a polyimide resin matrix or impregnant therefor;

(B) an electric resistor element, desirably composed of two sets of wires which conduct electricity and which offer predetermined resistance to electricity, and wherein preferably the two sets are each placed on either side of the support or substrate (A), the wires in the same set are parallel to each other, the wires of one set are arranged cross-wise with respect to the wires in the other set, the wires are coated with a thermostable, electrically-insulating coating or varnish, the chemical nature of which is different from that of the polyimide resin comprising the support (A); and (C) means for coupling the ends of the wires in operable engagement with an electric power source.

Several variations, modifications, and optional components of the heating elements according to the invention are also envisaged, as will hereinafter be more fully seen.

BRIEF DESCRIPTION OF THE DRAWINGS

As can be readily seen from the accompanying drawings and descriptions which follow.

DETAILED DESCRIPTION OF THE INVENTION

Figure 1:
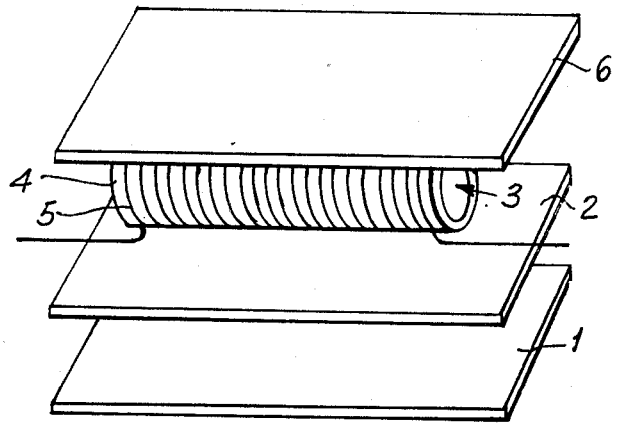
FIG. 1 is a schematic top perspective view of an assemblage of elements immediately prior to fabrication into a heating element according to the invention.

The particles comprising the strength reinforcing filler or charge defining the substrate (A) typically are individually elongate, flake-like or fibrous in geometrical nature. In the case of the fibrous material, same may either consist of simple fibers or may be a fabric, or even a nonwoven batt. The charge may, moreover, be either mineral or organic in nature.

The ratio between the weight of the elongate materials comprising the strength reinforcing charge and the total weight of the combination (1), i.e., the total weight of the polyimide resin plus strength reinforcing filler, typically ranges from between about 40 and 90%, preferably between 55 and 80%.

As exemplary of the elongate, strength reinforcing charge materials according to the invention, there may be mentioned mica flakes; asbestos fibers; glass or ceramic fibers; fabrics and nonwovens (notably batts or mats) of glass fibers; nonwovens of thermostable synthetic fibers, such as, for example, those of the aromatic polyamides or of polyamide-imide.

The polyimide resin comprising the support (A) is readily obtained by reaction between a bis-imide of an unsaturated dicarboxylic acid and a polyimide. It may be in the pre-polymer stage (still soluble in certain solvents) for use an an intermediate in the production of a heating element according to the invention, or it may be in the fully polymerized or polycondensed form (totally insoluble) in the heating elements, as same are normally used. The products of the reaction between a bis-imide and a diamine are described in French Pat. No. 1,555,564, in the French patent of Addition No. 96,189, in U.S. Pat. Nos. 3,562,223 and 3,658,764, and in the U.S. application for reissue Ser. No. 311,138, filed Dec. 1, 1972, to issue on July 19, 1977 as U.S. Pat. No. Re.

29,316; disclosures of each of the above being hereby expressly incorporated by reference.

The use of these polyamides deriving from bis-imides and polyamine is particularly advantageous according to this invention when one seeks to produce radiant heating elements, because such polyamides well absorb the heat produced by the electric resistor wires, and then will re-transmit the radiations in wavelengths suitable for heating.

Thus, the electrically-insulating material (A) is composed of a combination of elongate strength reinforcing filler or charge and a polyimide resin. More preferably, such combination is effected by impregnation. Thus, it is possible to impregnate the dry charge by using powder, or by using an aqueous solution or dispersion of a pre-polymer obtained by reaction between a bis-imide of an unsaturated dicarboxylic acid and a polyamine. The preparation of such pre-polymers is described, for example, in the French Pat. No. 1,555,564. The preparation of aqueous suspensions of such prepolymers is described in French Pat. No. 2,110,619. The impregnation of a fibrous sheet can be performed by the technique described in the latter patent. It is also possible to directly form a pre-impregnated fibrous sheet by following the various techniques described in French Pat. No. 2,156,452.

The aforesaid processes lead to the production of a pre-impregnated material composed of the elongate strength reinforcing filler or charge and of the prepolymer. Under further treatment (pressing, heating), these pre-impregnated materials are transformed into impregnated material of the type typically designated laminate or felt.

As a thermostable varnish or coating for the electric resistor wires, there are mentioned as exemplary the varnishes of the polyesterimide, polyimide, or, preferably, polyamide-imide types. As a preferred polyamide-imide, reference is made to those described in French Pat. No. 1,498,015 and U.S. Pat. No. 3,541,038, the disclosures of both of which being hereby expressly incorporated by reference. Preferably, the polyamide-imides are those obtained by reaction between trimellitic anhydride and aromatic isocyanates; this basic recipe can be modified in many ways, for example, by adding polymer or non-polymer additives, or by adding comonomers copolymerizable with trimellitic anhydride and diisocyanate.

Figure 9:
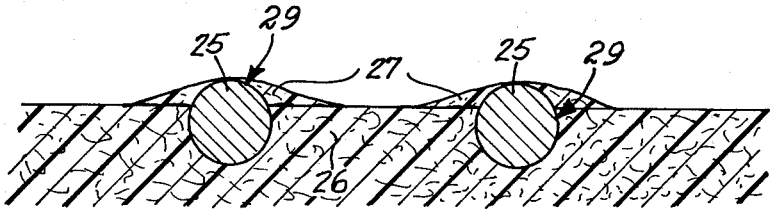
FIG. 9 is another cross-sectional view of the embedding of wires in a support according to the invention.

An especially desirable feature of the invention is that the varnished or coated electric wires are inlaid in the electrically-insulating material (A). When the degree of inlaying is 100%, the varnished metal electric wire may be coated with a certain layer of polyimide resin (originating, for example, from the flow produced during a pressure operation). The thickness of such coat generally is quite small, on the order of a few microns (usually lower than 50μ, preferably lower than 10μ). When the degree of inlaying is less than 100%, the surface of the heating element may not be perfectly flat in places, and present corrugations where the wires are located (see FIG. 9). The flow of resin forms a nexus between the substrate and the resistor wire. In order to obtain this configuration, the ram surfaces, during the pressure operations, have a certain useful flexibility.

Generally, the heating elements within the ambit of this invention are rigid or semirigid. The term semirigid elements is intended to denote a material that can withstand a non-permanent elastic deformation by curvature up to a radius of 3 cm.

It is preferable to use metal electric wires, having a diameter ranging between 0.05 and 0.8 mm, spaced at intervals of approximately 1 to 10 mm.

In another desirable embodiment of this invention, the heating elements described above also include:

(4) a second layer of electrically-insulating material of the type described with reference to the electrically-insulating material (1), located against one of the faces of such material (1) (and adhered thereto); and (5) a metal layer covering the second face of layer (4).

These various layers (1), (2), (4) and (5) are thus permanently adhered to one another, by chemical bonding or by glue.

The metal layer may play several roles, depending on the application envisaged. It may act as a reflecting layer, the purpose of which is to reflect the radiations; this is of special interest in the case of radiant heating elements. It can also serve as a layer to distribute the heat. Thus, this metal layer can be composed of a polished metal plate, such as aluminum foil.

Since the plate or foil is an integral part of the assembly, it is unnecessary to use great thicknesses. Generally, any thickness ranging between 10 and 100μ (in the case of a foil that can be handled) is satisfactory for radiation (reflecting layer). For a heat-distributing layer, greater thicknesses are sometimes preferred, which may have thicknesses of up to 0.5 mm or even 3 mm, for the purpose of obtaining a more rigid shape and of completely plating the object on which the heat distribution is to take place. These thicknesses, however, may vary, depending on the nature of the entity sought to be heated, and by the heating elements fabricated according to the invention.

Metals other than aluminum can also be used (for example, nickel, ferro-nickel). It is also possible to cause the metal to be deposited by chemical means, electrochemical means or by vaporization in a vacuum, in which case the thickness of the metal layer can range between 0.5 and 5μ. In the case of deposits on these heating elements intended for radiation applications (radiant heating elements), it is important that the surface of the reflecting layer be perfectly smooth. In that event wherein their function is that of distributing heat, conduction by a resin charged with heat-conducting particles is sufficient.

In another embodiment of the invention, the heating elements contain, in addition to their components (1), (2), (3), (4) and (5), a further layer (4') of the same nature as (4), but located on the other side of (1) with reference to (4). Of course, this layer is connected (adhered) to layer (1), as layers (1) and (4) are connected or adhered to each other. Such layer (4') is of particular interest and importance when such heating elements according to this invention are used to heat metal surfaces, objects or containers by conduction.

The heating elements that have been described above can also have different shapes. The most widely used shape is a flat shape; but same can also be more or less curved.

For certain applications, other, more special shapes are in order and are readily fabricated.

Thus, the properties of the heating elements according to the invention are such that it is advantageous to use them also to fulfill the function of container or vessel. Thus, by according such elements the shape of a basin (preferably equipped with layer (4) and, ultimately, (5), on the material receiving side of such item), one obtains very practical, very easily handled and very light heating containers; the process of construction of such basins will be described below; preferably, a flat heating element is produced, which is then further folded to give it the appropriate shape before effecting hardening of the resin.

The invention also envisages several processes for the production of such heating elements; such processes being more; such processes being more readily understood by referring to the drawings.

In accordance with a first embodiment of the invention, an object of substantially cylindrical shape is produced, composed of a cylindrical, pre-impregnated substance bearing on its outer surface a spiral-shaped coil of enamelled conducting wires (the pre-impregnated substance itself is composed of a fiber- or flake-like material impregnated with a polyimide pre-polymer), then the cylinder is pressed under heat. Pressures of 5 to 100 bars are generally quite suitable; the pressing operation or compression step is generally performed under heat, so as to soften the polyimide pre-polymer, thus obtaining the advantage of fully polycondensing the polyimide; the wires are inlaid under the effect of the pressure and of the softening of the pre-polymer.

Such a process makes it possible to obtain heating elements containing only the components (A) and (B). In order to obtain the other heating elements, a superimposition is performed, employing on the one hand the cylindrical object described above and, in addition thereto, one, or, optionally, two flattened pre-impregnated layers [the purpose of which is to form the layers (D) and (D')] and, also optionally, a metal layer [reflecting or heat-distributing, the purpose of which is to form the layer (E)].

In one preferred embodiment of the invention, as shown in the FIG. 1, there are successively superimposed:

$\alpha$—reflecting layer 1;

$\beta$—a pre-impregnated substrate 2, composed of a fiber- or flake-like matrix impregnated by means of a polyimide pre-polymer;

$\gamma$—a preform of substantially cylindrical shape 3, composed of a pre-impregnated material 4, such as described under $\beta$, there being entwined on its outer surface a spiral-shaped coil 5, fabricated from one or more enamelled conducting wires (producing electric resistance, and preferably made of metal); and $\delta$—a pre-impregnated material 6, such as described under $\beta$, and then compressing this assemblage of elements at a temperature such that consolidation of the assembly of the various components is effected.

Figure 2:
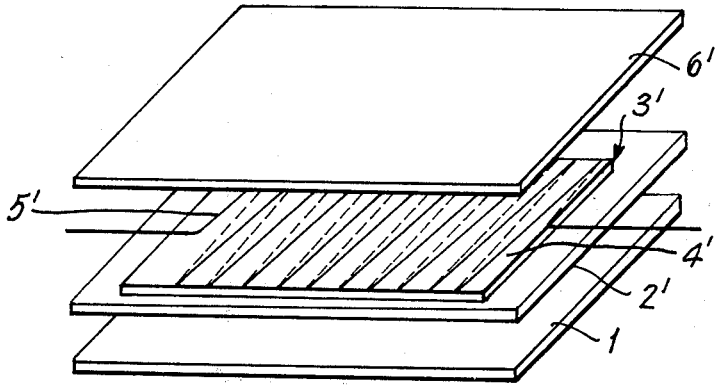
FIG. 2 is a schematic, exploded top perspective view of the assemblage of elements depicted in FIG. 1 subsequent to a preferred form of processing according to the invention.

FIG. 2 illustrates the FIG. 1 embodiment of the invention, wherein the various elements defining the finished product are depicted, as an exploded view. Reference numberal 1 represents the reflecting material. Reference numerals 2' and 6' represent the electrically-insulating materials after pressure treatment and hardening of the polyimide resin. The numeral 3' represents the active (radiant) element, resulting from compressing the cylinder shown as 3 in the FIG. 1. The numeral 3' denotes the combination of the material 4 (now identified as 4' in FIG. 2) and of the resistor 5 (now identified as 5' in FIG. 2) described above as composing the heating elements according to the invention. Item 2' represents the second layer of insulating material 2 described above. Item 1 represents the reflecting or heat-distributing layer (E) described above Reference numeral 6' represents the ultimate layer (D') mentioned above.

Thus, in several embodiments of the invention, it is possible to eliminate the additional layer 6 or 6'; it is possible to eliminate the reflecting layer 1, as well as the added layer 2 or 2'. And the reflecting layer 1 may ultimately perform the function of distributing heat.

Figure 3:
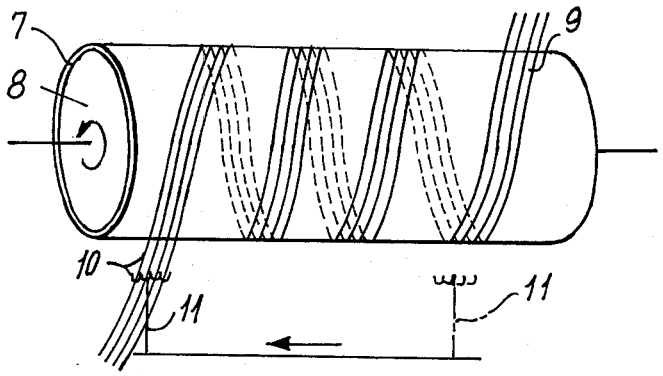
FIG. 3 is a schematic side perspective view of another assemblage of elements useful in fabricating a heating element according to the invention.

The electric resistor on its support can usefully be fabricated in the following manner, as illustrated in the FIG. 3:

A pre-impregnated preform 7, such as those described above, is utilized, and such pre-impregnated preform is wound around a mandrel 8. The circumference of the mandrel—and the size of the pre-impregnated preform are so calculated as to correspond to twice one of the dimensions of the heating plate, while the length of the mandrel is substantially equal to that of the heating plate. It is specified that, in practice, for obvious safety reasons, it is desirable that the dimensions of the heating area be slightly smaller (for example, by a few centimeters) than the overall dimensions of the article.

A spiral-shaped coil 9 is then produced on the pre-impregnated preform, by means of an enamelled (or varnished) conducting wire 10. In order to do so, it is desirable to employ a mandrel performing a rotary motion about its axis, and the coil is obtained by moving a wire guide 11 parallel to a generatrix of the mandrel. The number of wires used and the number of revolutions depend on the wire used and on the heating density that is selected. An example of the construction of an article will be given below. As a general rule, it is preferred to use several wires, for example between two and ten, which are coiled and spaced at intervals of the order of 1 to 10 mm. The diameter of the wire generally ranges between 0.05 and 0.8 mm, and the material composing the wire may be selected among the metals or alloys commonly used in the production of electric resistors. Particularly advantageous results were obtained with a nickel-chrome wire having a resistance of 36 ohm/mm.

After winding, the mandrel is withdrawn from the cylinder formed by the pre-impregnated preform having the coils of conducting wire on its outer surface.

In the construction of articles in conformity with this invention, one places on the plate of a press either the cylinder alone, or the reflecting support, with the first insulating component (pre-impregnated), the cylinder described above and finally (and eventually) the second insulating component; then the assembly is subjected to strong pressure. In order to facilitate the positioning of the second insulating component, it is of course possible to more or less flatten the cylinder.

The entire assembly is compressed (generally between 5 and 100 bars) at a temperature that gives rise to a softening of the polyimide resin present in the one or more component elements. Since the pre-polymers obtained from a bis-maleimide and a diamine generally have a softening point ranging between 80° and 200° C., the temperature at the press is generally set between 100° and 250° C. Preferably, for the purpose of making possible an effective bonding (or assembly) of the various components, the temperature is higher than 150° C. Generally, the heating of the pre-polymers described above renders it possible to obtain in succession their softening and their hardening. Of course, it is possible to proceed to a reheating of the assembly, for example, for a few hours at 200° C. or more.

During the pressure treatment, the cylinder containing the coil is flattened and one obtains, on either side of a layer of electrically insulating material (pre-impregnated substance used in the construction of the cylinder) two sets of conducting wires, arranged substantially parallel to one another in each set, the direction of the wires being crosswise between the two sets (FIG. 2).

It should be noted that, when one has proceeded in this manner, with a pre-impregnated substance based on a fabric, one obtains two fiber-like layers (2 layers of fabric) between the 2 sets of heating electric wires.

The same process can be carried out by not using a pre-impregnated preform based on a fabric, but rather a felt or paper, notably based on asbestos fibers, such as those, the preparation of which is described below.

A further manufacturing process for heating elements according to this invention is described below. It more easily produces a heating element in the form of a plate or ribbon presenting a certain flexibility (so-called semi-rigid article), composed of an asbestos felt impregnated with polyimide pre-polymer, on the surface of which is inlaid the enamelled (varnished) conducting wire. In this process, one prepares, according to standard papermaking techniques, the asbestos felt by selecting the polyimide prepolymer and directly pouring all the ingredients into the mixer, namely, at the same time as the water charge, the fibers (preferably of asbestos), and the bonding agent (polyimide pre-polymer) in powder form. Then, on a conventional papermaking machine, a felt is formed, from which the water is extracted on the one hand by drying in the air and applying a vacuum, and on the other hand by drying at a temperature of the order of 70°–100° C., generally by passing the felt through a ventilated oven.

In this felt, the bonding agent is always present in the form of a pre-polymer, which reflects that it is susceptible of being softened by heating. The felt thus prepared displays a density ranging between 0.5 and 1.2, while at the final stage, that is, after the pressing of the felt and the hardening of the polyimide, the density of the material is approximately 1.5 to 1.6.

Figure 4:
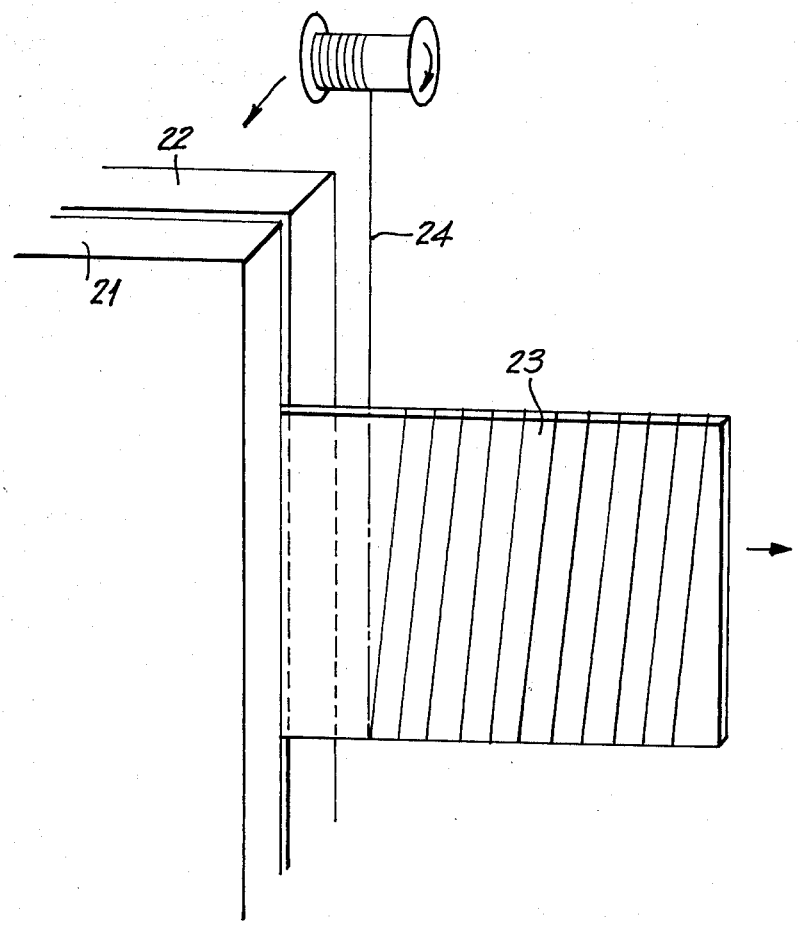
FIG. 4 is a schematic side perspective view of yet another assemblage of elements useful in fabricating a heating element in accordance with the invention.
Figure 5:
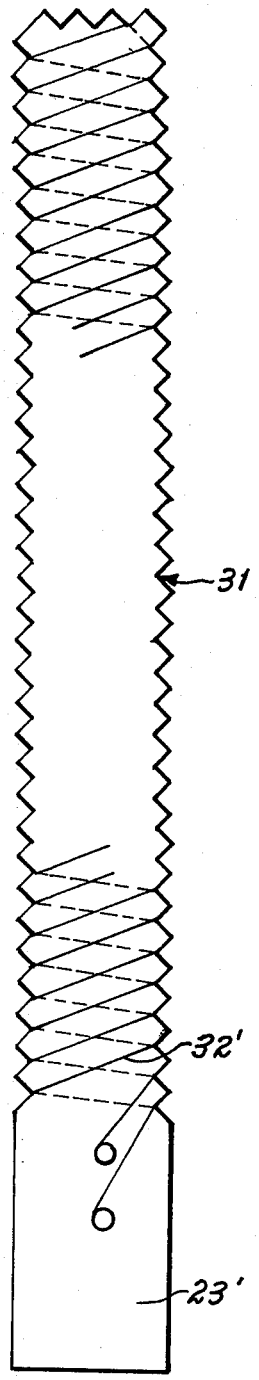
FIG. 5 is a plan view of one type of heating element according to the invention.
Figure 6:
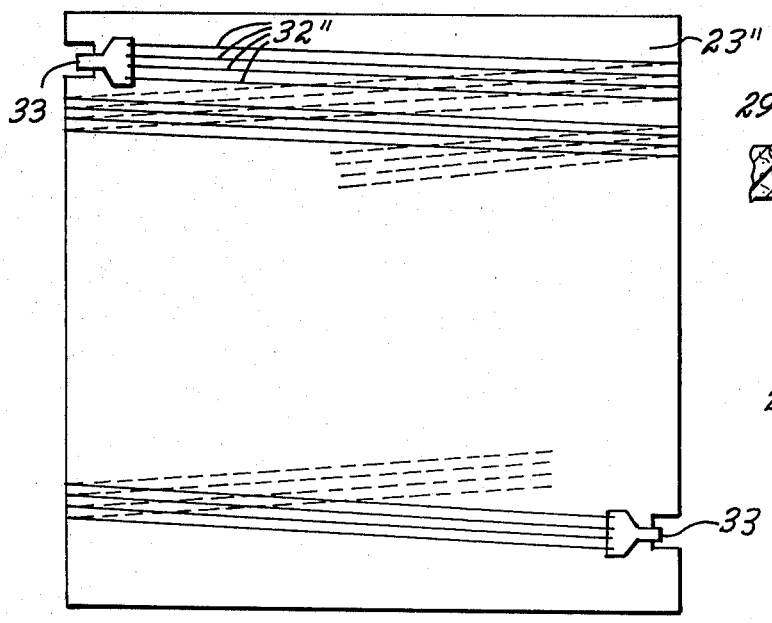
FIG. 6 is a plan view of another heating element in accordance with the invention.

Next, one proceeds to wind the enamelled electric conductor around the foil or ribbon thus prepared. In view of the thinness of the foil or ribbon, it is desirable to guide the foil or ribbon through rigid elements, for example following the technique shown in FIG. 4. In that technique, rigid plates 21 and 22 are set at either side of the pre-impregnated foil or ribbon 23; then one draws the foil (in the direction of the arrow) and, at the same time, proceeds to wind the enamelled wire 24 around the foil by means of any suitable winder rotary (not shown). As shown in FIG. 5, it is possible to provide notches 31 for the purpose of maintaining a constant distance between wires. As shown in FIGS. 5 and 6, it is possible to form a coil so that the ends of the electric resistor 32' on base 23' are located close to each other (FIG. 5) or to proceed to wind several wires 32'' on base 23'' (FIG. 6), connected to common lugs 33 for connection to a source of power (not shown).

After the installation of the enamelled wire, the asbestos felt is compressed hot. The purposes of this operation are threefold: to cause the enamelled wire to become inlaid, to increase the density of the material and to effect softening of the polyimide pre-polymer. As a general rule, the compression is performed at a temperature ranging between 100° and 250° C., preferably between 160° and 220° C. The pressure generally ranges between 5 and 100 bars.

Figure 7:
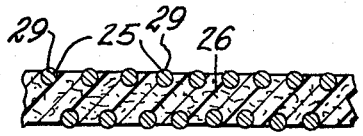
FIG. 7 is an enlarged cross-sectional view of the heating elements shown in either of FIGS. 5 or 6.
Figure 8:
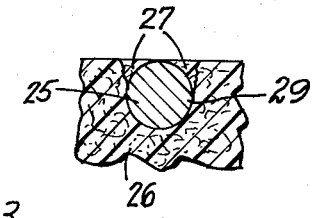
FIG. 8 is a still more enlarged cross-sectional view of the embedding of one of the wires as generally depicted in the FIG. 7.

The material thus obtained is shown in cross-section in FIGS. 7 and 8. In those figures, item 25 reflects the section of enamelled conducting wire, item 26 shows an asbestos felt impregnated with polyimide. Item 27 in FIG. 8 represents a certain amount of polyimide which flowed during the pressing operation and therefore reinforces the inlaying of the enamelled wire and item 29 represents the varnish coating of the resistance element. FIG. 8 simply shows, in an enlarged view, a detail of FIG. 7 in the area of the wires.

The heating element thus prepared can, if necessary, be completed by heat compressing with a pre-impregnated component and a metal layer; however, it is not necessary to distinguish the various stages of compression/heating which can be combined into a single operation.

The ends of the conducting wires used in this invention, obtained in one or the other of the embodiments described above, can then be connected by the usual means to an electric power source, in practice interposing the appropriate operating and control devices. When several wires are used, of course, it is possible, by connecting them separately, to construct elements with variable heating speeds (that is, with several levels of heating power).

Figure 10:
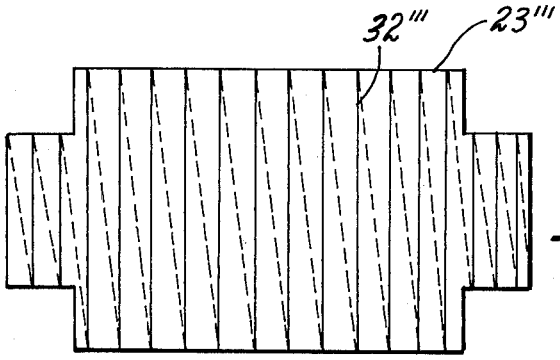
FIG. 10 is a plan view of another embodiment of a heating element according to the invention.

FIG. 10 depicts an intermediate element used in the production of heating containers. In this version, a plate 23''' in the form illustrated is constructed, containing on its surface the electric resistor wires 32''' and made of an electrically-insulating material in the manner of one or the other of the embodiments described above (impregnated fabric, impregnated asbestos fibers). The plate, in the form shown in FIG. 10, is still in the pre-polymer form. By folding the edges, the plate is easily given the shape of a basin, and one can then proceed to the final pressing and heating operation, after having installed layers of the (D) and (E) type inside the basin.

The articles or elements according to this invention may constitute the heating elements of the most diverse heating devices. They may be devices operating by radiation, by conduction or by convection, and the particular structure of the heating element is adapted to such type of operation as described above. The heating elements envisaged by the invention are particularly interesting because of their numerous properties: they offer full reliability from an electrical viewpoint, which means safety of operation; the use on the wires of a varnish different from the polyimide resin confers increased safety; the heating elements are particularly suitable for use in the most diverse of electric household appliances.

The rapid heating of cold and badly insulated rooms is equally well realized by the use of a radiant heating device. Of course, the technique described above and which will be illustrated by the examples which follow makes possible the production of articles of widely varying dimensions. The operating temperature of these articles, when they are operating by radiation, ranges approximately between 150° and 250° C., and, under such conditions, they provide a very pleasant heat source.

In order to further illustrate the invention and the advantages thereof, the following specific examples are given, it being understood that same are intended only as illustrative and in nowise limitative.

EXAMPLE 1

In this example, the fabrication of a 400-watt element is described in detail.

An element having overall dimensions of 48×25 cm was produced.

An aluminum foil of this size was selected, having a thickness of 30μ.

The insulating supports were formed of a glass fabric of satin type, weighing 200 g/m², impregnated with polyimide prepolymer. The pre-polymer was prepared from N,N', 4,4'-diphenylmethane bis-maleimide and bis(amino-4-phenyl) methane (bis imide/diamine molar ratio=2.5) and had a softening point of 100° C. It was used in the form of a solution in N-methylpyrrolidone (50 g of pre-polymer in 100 g of solution) and the impregnation of the glass fabric was performed by soaking. Then the pre-impregnated substance was dried ¼ h at 150° C.). The amount of pre-polymer deposited on the glass fabric was approximately 40 g per 100 g of pre-impregnated substance. Two pieces measuring 41×25 cm were cut from the sheet of pre-impregnated substance, to be used in forming the two supports surrounding the resistor, as well as a piece measuring 82×22 cm. This latter piece was wound on a 25.5-cm-diameter mandrel of 22 cm length.

The mandrel was rotated and, by means of a wire guide moving at a rate of 13 mm for each revolution of the mandrel, there was wound around the pre-impregnated substance 5 nickel-chrome wires (resistance 36 ohm/cm) having a diameter of 0.2 mm, treated with 6 coats of polyamide-imide varnish (a product obtained from bis(isocyanate-4-phenyl) methane and trimellitic anhydride, in a molar ratio of approximately 1), applied in the form of a solution in a mixture of N-methyl-pyrrolidone and xylene.

The thickness of the varnish was 2/100 mm. The length of the 5 wires was 16 m and the thread of the coil was on the order of 2 to 3 mm. The length of the coiled segment was 20 cm. Then the mandrel was removed.

Next, there was superimposed on the plate of a press, in succession, the aluminum foil, one of the pre-impregnated compounds, the cylinder bearing the coil, the second pre-impregnated component, and the assembly compressed while brought to 180° C. for 10 min. at 10 bars.

An article measuring 41×25 cm was obtained, containing a radiating area of 41×20 cm, which was reheated for 24 hours at 200° C. The two ends of the group of 5 wires (input and output) were fitted with standard outlet plugs which made possible connection to an electric power source (220 V).

The heating density of the radiant heating element was 0.48 W/cm², approximately. The operating temperature of the element was 190° C. and, after 2000 hours of operation (cycles of 13.5 min. in operation followed by 1.5 min. stoppage, then, again, operation-stoppage, etc.) no deterioration was observed in the article, nor any change in its performance.

EXAMPLE 2

(A) Preparation of cardboard based on asbestos and polyimide

In the mixer of a typical paper-making machine, there were charged:

1000 l of water;

80 kg of polyimide pre-polymer as described in Example 1;

120 kg of asbestos fibers (average length of the fibers: 3 mm); and 10 l of potato starch solution (viscosity approximately 5 poises; this is an ingredient well known as a bonding agent in the manufacture of paper and cardboard).

The combination was homogenized by shaking, transferred onto a metal mesh in the form of a ribbon where the water was eliminated by natural dripping, followed by aspiration; a paper of 1 m in width was obtained, which was transferred onto a cylinder having a circumference of 2 m. The cylinder was allowed to revolve until 5 layers of paper were rolled. This superimposed set was cut along a generatrix of the cylinder, thus producing a piece of cardboard of the approximate dimensions of 2 m×1 m. The cardboard was placed on a belt which was conveyed through a drying oven of the hot air type, at a temperature of 100° C. in the first half of its length and at 90° C. in the second half; the belt with the cardboard being conveyed through the oven at 60 m/h.

Finally, there was obtained dry cardboard, weighing 2 kg/m², and containing approximately 39% polyimide pre-polymer and 61% asbestos.

The cardboard was cut to produce squares with one-meter sides.

(B) Production of heating elements

The cardboard thus obtained was cut, by means of serrated shears, in the shape of rectangular strips of 70 cm in length by 5 cm in width. Next, same were entwined with a wire of kanthal alloy (an alloy of iron-nickel-chrome with a resistance of 36 ohm/m), of 0.2 mm in diameter, enamelled with a polyamide-imide varnish as described in Example 1. The coiling was performed on the rectangular strips so as to obtain an article such as is shown in FIG. 5; 22 m of wire were thus arranged, which at 220 volts corresponds to a power of 0.17 watts/cm². The ends of the wire were fixed to brass riveted eyelets, which were then used for connection to the electric power grid.

This element was compressed at 20 bars and for 30 min. at 200° C. between the plates of a press; the plates were covered with glass fabric sheets coated with Teflon in order to prevent any adhesion. The pressing operation fully inlaid the electric resistor wire. During the 30-min. pressing operation, the press was rapidly opened twice in order to permit the water retained by the asbestos cardboard to flow away.

This heating element operated for 5800 hours without any change in performance or appearance, except for a slight burnishing during the first few hours of operation, coinciding with the completion of the polycondensation of the polyimide resin.

EXAMPLE 3

A piece of cardboard such as obtained under item A in Example 2 was cut into a rectangle measuring 21 cm×30 cm. Next, there were coiled 4 kanthal alloy wires (diameter: 0.2 mm; resistance: 44 ohm/m), enamelled with a polyamide-imide varnish as described in Example 1. The four wires were set parallel to one another, in two sets on either side of the plate, on a surface of 520 cm² (21 cm×25 cm); the wires in the same set were parallel to one another; between the two sets, the wires were arranged crosswise. At each end the 4 wires were grouped together and connected to copper strips which were used for connection to the electric power grid.

On one side of this element was placed a pre-impregnated element measuring 21 cm×30 cm, obtained by impregnating a glass fabric with polyimide pre-polymer as described in Example 1 (60 g of fabric per 40 g of polyimide pre-polymer); then, to this pre-impregnated element was added an aluminum sheet with a thickness of 50μ. This assembly was then compressed for 30 min. at 200° C. at 20 bars between two press plated covered with Teflon-coated glass fabric. During the 30-min. pressing operation, the press was rapidly opened twice in order to let the water retained by the asbestos cardboard to escape. The final operation consisted of heating for 24 h at 200° C. in a ventilated stove.

The heating element thus obtained developed a power (mainly radiation) of 250 watts on 520 $cm^2$ at 220 volts.

Such element was operated for 1100 h without any change in its electric properties. In practice, same operated in alternating cycles: 12 min. 30 seconds in operation and 2 min. 30 seconds out of operation. The purpose of this pattern is to better simulate actual operation, and to test the heating elements under severe operating conditions (the severity of the operating conditions is the result of the succession of stresses from expansion and contraction).

EXAMPLE 4

(A) Preparation of asbestos and polyimide-based paper

In the furnish of a typical papermaking machine, there were charged:

1000 l of water;

80 kg of polyimide pre-polymer, such as described in Example 1;

120 kg of asbestos fibers (average length of the fibers: 3 mm); and 10 l starch solution, as described in Example 3.

The mixture was homogenized by shaking, transferred onto a metal mesh in the form of a strip, from which the water was expressed by natural dripping, followed by aspiration, and there resulted a piece of paper having a width of 1 m, which was next transferred from the belt onto a metal cylinder having a circumference of 2 m; then the paper was moved from the cylinder onto a new belt conveyed through a hot-air drying oven. The paper on the belt passed through the oven at a speed of 120 m/h; the temperature of the oven was 90° C. along the first two-thirds of its length and 75° C. in the final third.

Finally, there was obtained a dry paper, weighing 400 g/$m^2$ and containing approximately 39% polyimide pre-polymer and 61% asbestos. The paper was cut in order to produce squares having one-meter sides.

(B) Production of the heating element

Rectangles of the paper thus prepared measuring 30 cm33 42 cm were wound around a revolving mandrel having a diameter of 13.3 cm.

For the purpose of facilitating the coiling of the electric resistor wire, the paper was fixed to the mandrel by means of a very slight adhesive coat. Then coiling of 4 enamelled metal wires was effected, similar to those used in Example 3 and having a length of 17 m; the wires were wound around the mandrel by means of a wire guide.

The paper cylinder equipped with the wire coil was removed from the mandrel, heated for 15 minutes at 200° C. to dry the adhesive and then flattened by pressing.

Next, the following were superimposed:

the flattened cylinder;

a glass fabric impregnated with polyimide pre-polymer such as was used in Example 3; and an aluminum foil with a thickness of 50 microns.

Same were pressed for 30 minutes at 20 bars and 200° C.

There was obtained a heating element developing (mainly by radiation) 250 watts at 220 volts over a surface of 520 $cm^2$ (25 cm×21 cm).

This heating element was used with periods of interrupted heating, as described in Example 3.

At the conclusion of 1100 hours, the element continued to operate perfectly normally.

While the invention has now been described in terms of various preferred embodiments, the skilled artisan will readily appreciate that various substitutions, modifications, changes, and omissions, may be made without departing from the spirit thereof. Accordingly, it is intended that the scope of the present invention be limited solely by that of the following claims.

What is claimed is:

1. A heating element which comprises:

a generally flat and generally solid, electrically insulating substrate, said substrate comprising a reinforced polyimide resin composite;

a continuous electric resistor wire element of a predetermined resistance wound around and at least partially inlain within said composite, said electric resistor wire element being integrally coated with a layer of a thermostable, electrically insulating coating; and means for coupling said electric resistor wire element with an electric power source.

2. The heating element as defined by claim 1, wherein said electric resistor wire element comprises a single, continuous wire.

3. The heating element as defined by claim 2, wherein said single, continuous wire of the electric resistor element defines a first set of wire segments provided on a first side of said substrate and a second set of wire segments provided on a second side of said substrate.

4. The heating element as defined by claim 3, wherein the wire segments of the first set are parallel to one another and the wire segments of the second set are parallel to one another with the wire segments of the first set being oriented crosswise with respect to the wire segments of the second set.

5. The heating element as defined by claim 1, wherein the polyimide resin composite comprises a strength reinforcing filler elongate in geometrical configuration.

6. The heating element as defined by claim 5, wherein the reinforcing filler is selected from the group consisting of fibers and flakes.

7. The heating element as defined by claim 6, wherein the thermostable, electrically insulating coating is of a material different from the polyimide resin comprising the substrate.

8. The heating element as defined by claim 7, wherein, the reinforcing filler comprises from about 40 to 90% of the total weight thereof.

9. The heating element as defined by claim 8, wherein the reinforcing filler comprises from about 55 to 80% of the total weight thereof.

10. The heating element as defined by claim 6, wherein the reinforcing filler is selected from the group consisting of mica flakes, asbestos fibers, glass fibers, ceramic fibers, nonwovens comprised of glass fibers, batts of glass fibers and nonwovens comprised of asbestos fibers.

11. The heating element as defined by claim 8, wherein the polyimide resin comprising the substrate is the reaction product of a bis-imide of an unsaturated dicarboxylic acid and a polyamine.

12. The heating element as defined by claim 11, wherein the polyimide resin is a pre-polymer.

13. The heating element as defined by claim 8, wherein the thermostable, electrically insulating coating is a polyamide-imide.

14. The heating element as defined by claim 8, wherein the electric resistor element is inlain to from about 80 to 100% of its diameter.

15. The heating element as defined by claim 14, wherein the plurality of wire segments are metal and have diameters ranging from between about 0.05 and 0.8 mm.

16. The heating element as defined by claim 15, wherein said wire segments are spaced at intervals of between about 1 and 10 mm.

17. The heating element as defined by claim 8, further comprising a second shaped, electrically insulating substrate contiguously adhered to the substrate.

18. The heating element as defined by claim 17, further comprising a metal layer face surface provided on an outer surface of said second shaped, electrically insulating substrate.

19. The heating element as defined by claim 18, wherein said metal layer comprises a heat reflecting face surface.

20. The heating element as defined by claim 18, wherein said metal layer comprises a heat distributing face surface.

21. The heating element as defined by claim 18, wherein the metal is aluminum.

22. The heating element as defined by claim 17, further comprising a third shaped, electrically insulating substrate, said third substrate also being contiguously adhered to the substrate, but on a side opposite to that which the said second substrate is adhered.

23. The heating element as defined by claim 8, in the shape of a receptacle.

24. The heating element as defined by claim 1, wherein said electric resistor wire element comprises at least two continuous parallel wires.

25. The heating element as defined by claim 24, wherein said wires define a first set of wire segments provided on a first side of said substrate and a second set of wire segments provided on a second side of said substrate.

26. The heating element as defined by claim 25, wherein the wire segments of the first set are parallel to one another and the wire segments of the second set are parallel to one another with the wire segments of the first set being oriented crosswise with respect to the wire segments of the second set.

* * * * *